United States Patent [19]

Tojza et al.

[11] 4,155,437

[45] May 22, 1979

[54] TRANSPORT DEVICE FOR GAME MACHINE

[75] Inventors: Roman A. Tojza, Chicago; Walter M. Burnside, Waukegan, both of Ill.

[73] Assignee: Bally Manufacturing Corporation, Chicago, Ill.

[21] Appl. No.: 821,184

[22] Filed: Aug. 2, 1977

[51] Int. Cl.[2] ..... G07F 1/04

[52] U.S. Cl. ..... 194/1 K

[58] Field of Search ..... 194/76, 99, 81, 102, 194/86, 10, 1 G, DIG. 11, 1 K, 1 E; 133/3 R, 3 H, 3 F, 8 E

[56] References Cited

U.S. PATENT DOCUMENTS

| | | | |
|---|---|---|---|
| 2,285,532 | 6/1942 | Rockola et al. | 194/1 K |
| 3,717,158 | 2/1973 | Black | 133/8 |
| 3,768,618 | 10/1973 | Collins | 194/102 |

*Primary Examiner*—Stanley H. Tollberg

*Attorney, Agent, or Firm*—Hill, Gross, Simpson, Van Santen, Steadman, Chiara & Simpson

[57] ABSTRACT

A transport device for a game machine which allows a plurality of coins to be automatically accepted into the machine to actuate a credit switch so that the machine can be enabled for energization rapidly and automatically.

9 Claims, 10 Drawing Figures

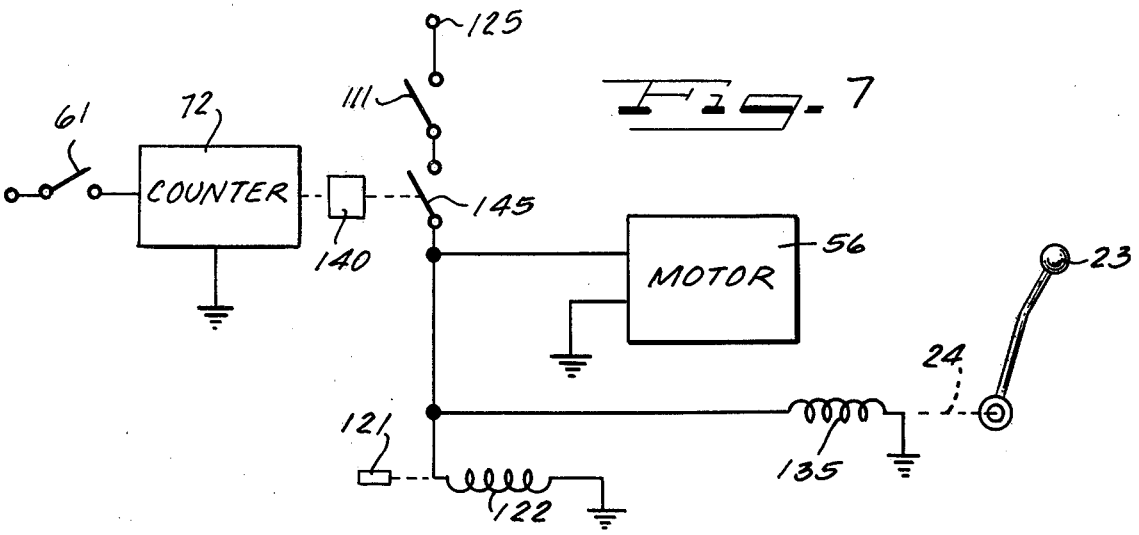
Fig. 7
Fig. 8
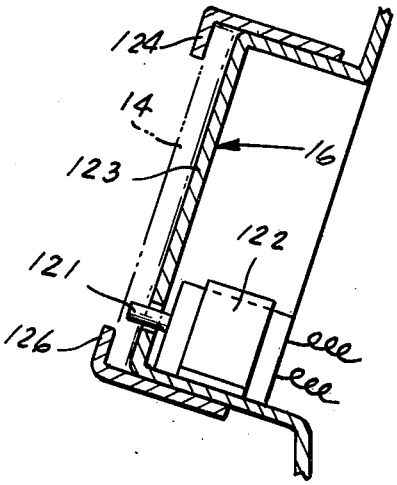
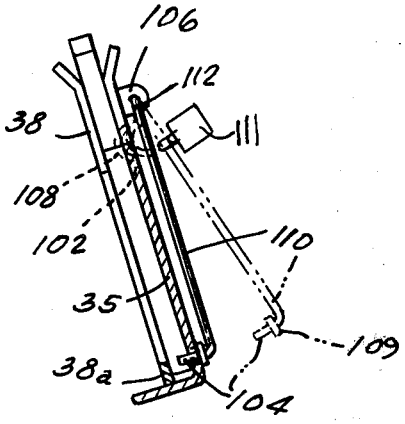
Fig. 10
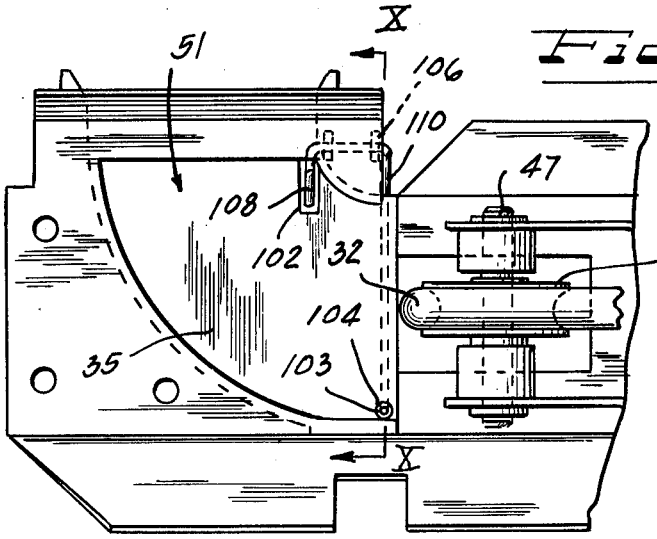
Fig. 9

TRANSPORT DEVICE FOR GAME MACHINE

BACKGROUND OF THE INVENTION

1. Field of the Invention

This invention relates in general to game machines and in particular to a novel coin transport device for a game machine.

2. Description of the Prior Art

Game machines are known which can accept more than one coin so as to enable it for different play combinations before the machine is energized. However, normally, it is necessary to individually insert coins into the machine to obtain the various combinations and this requires a substantial time after the end of the previous play.

SUMMARY OF THE INVENTION

The present invention relates to a transport device for a game machine wherein a vertical chute into which coins can be manually inserted is connected to a horizontal chute wherein said coins can be stored and are visible from the front of the game machine with a coin switch which is energized each time a coin passes through the chute so as to automatically change the combinations in the machine and including a coin drive wheel which engages and moves the coin in the horizontal chute until the coin switch has been energized the maximum acceptable number of times for the particular machine. The coin chute also provides a channel which will hold the particular size coins for which the machine was designed but will drop coins of sizes smaller than the intended coin so that credit is not received for such coins.

The present invention assures that only the proper coin will energize the machine and also provides that the coins are continuously visible so that slugs and improper coins cannot be used in the machine since the coins are visible and also provides for rapid loading of the machine in an automatic manner so as to speed up the play of the machine.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 7 is a schematic view of the invention;

FIG. 8 is a sectional view illustrating a locking pin;

FIG. 9 is a sectional view illustrating the coin feeler switch; and

FIG. 10 is a plan view of the feeler switch.

DESCRIPTION OF THE PREFERRED EMBODIMENTS

Figure 1:
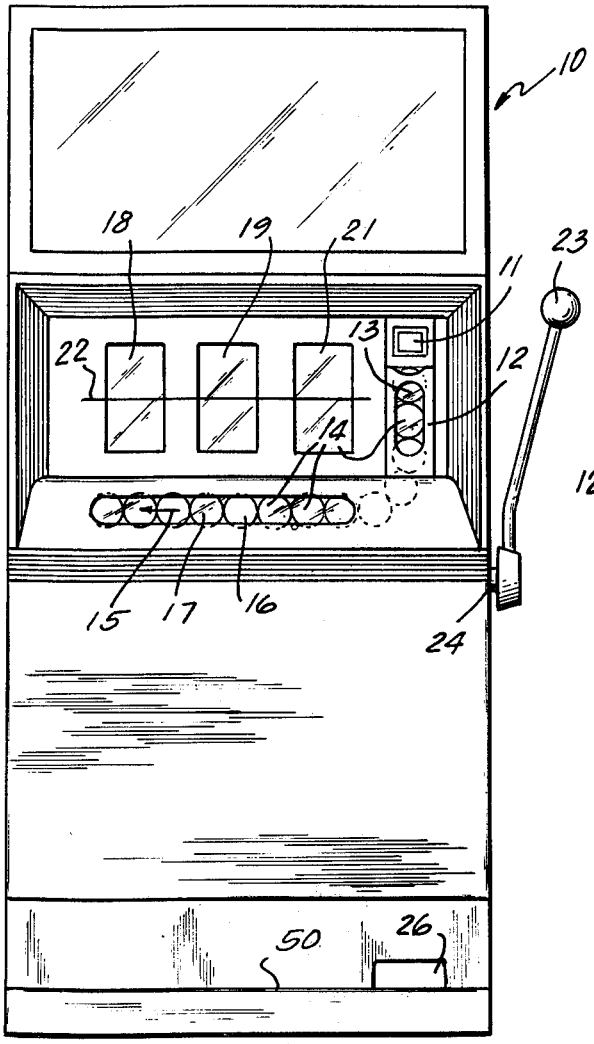
FIG. 1 is a front plan view of a game machine illustrating the novel transport device of the invention.

FIG. 1 is a front view of a gaming machine 10 which has a coin slot 11 and a vertical coin chute 12 with a window 13 through which coins 14 are visible. The machine also has a horizontal chute 16 with a window 17 through which the coins 14 are visible. The coins move in the direction shown by arrow 15. A plurality of reels such as the reels 18, 19 and 21 are mounted such that they are visible and can be observed relative to an indicia 22 formed on a window through which the reels 18, 19 and 21 can be observed. A handle 23 is connected to a shaft 24 for energizing the machine when the machine has been enabled by the insertion of coins.

In the present invention, the machine is automatically enabled in that the coins 14 can automatically be driven past the coin credit switch by providing coins 14 in the horizontal chute 17 and vertical chute 12 which have been deposited by the operator in the coin slot 11.

Figure 2:
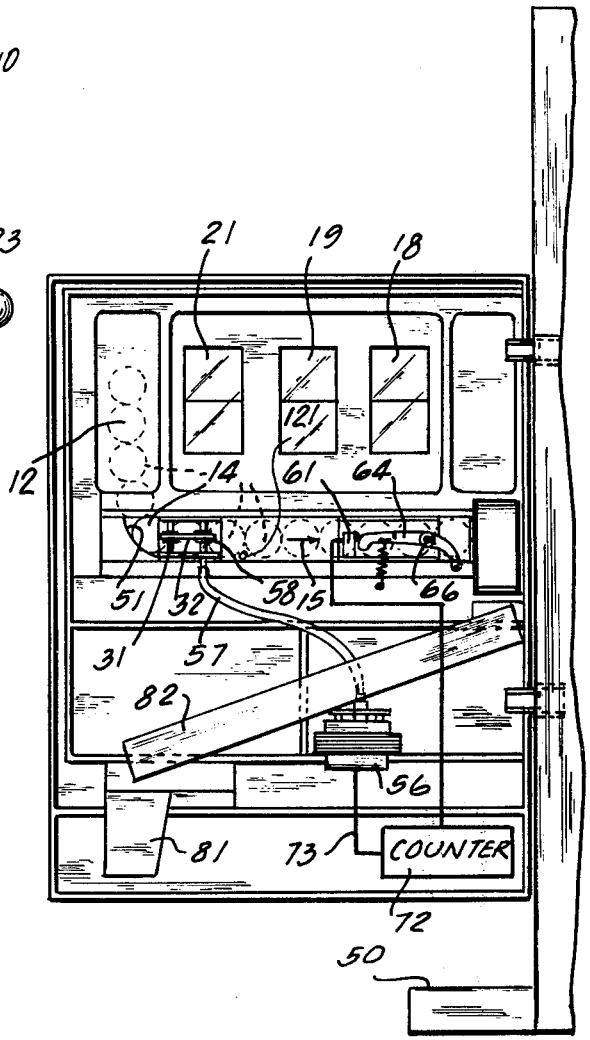
FIG. 2 is a view looking from the back of the door of the machine with the door open illustrating the coin transport device.
Figure 6:
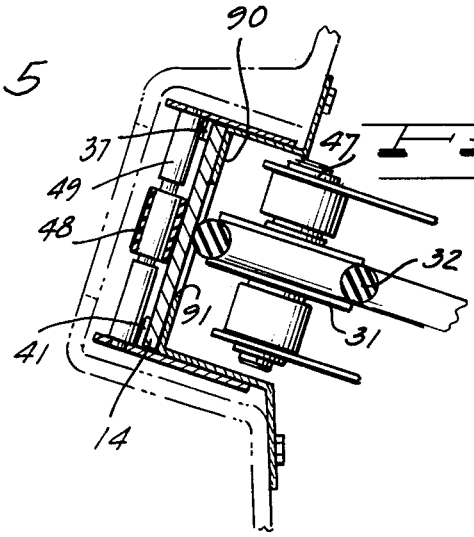
FIG. 6 is a detail view illustrating the coin drive mechanism.

FIG. 2 is a view of the machine looking from the inside of the door of the machine so as to show the coin driving mechanism comprising a coin driving roller 31 which has a rubber belt 32 engageable with a coin 14 in the chute 16 through a window 91 in a plate 90 of chute 16. As best shown in FIG. 6 in sectional view, the chute 16 has an upper portion formed with downwardly extending guide rail 37 and rear plate 90, between which the coin 14 is supported. The lower portion of the chute is formed with a plate 91 and upwardly extending guide rail 41 as shown.

Figure 5:
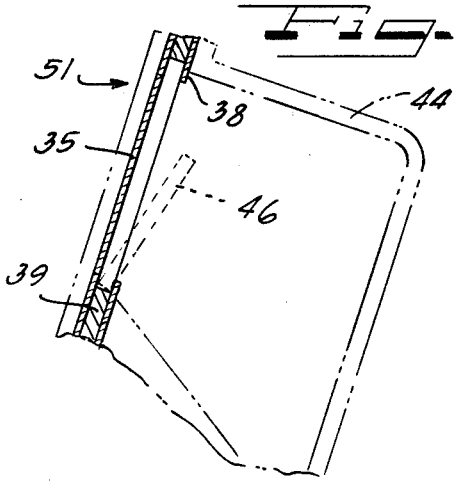
FIG. 5 is a detail sectional view illustrating the coin chute.

As shown in FIG. 6, the horizontal chute 16 is tilted from the vertical at an angle of about 18° such that if a coin smaller than the size of the coin for which the machine is designed is inserted into the machine when it reaches the horizontal chute 16 it will fall into the machine and be ejected without providing credit from such incorrect sized coin. FIG. 5 illustrates such a coin designated by 46 which is falling from the chute immediately after it has passed from the vertical chute 12 into a transition chute 51 which has a front wall 35 and upper guide 38 and lower guide 39, and before credit is provided by the coin. The chute 51 is supported by a suitable frame member 44 as illustrated in FIG. 5.

The coin driving roller 31 carries belt 32 and is supported on a shaft 47 and engages the coin 14 and presses it between a pressure roller 48 mounted on a shaft 49 as shown in FIG. 6. An opening 91 is formed in plate 90 for this purpose.

Figure 3:
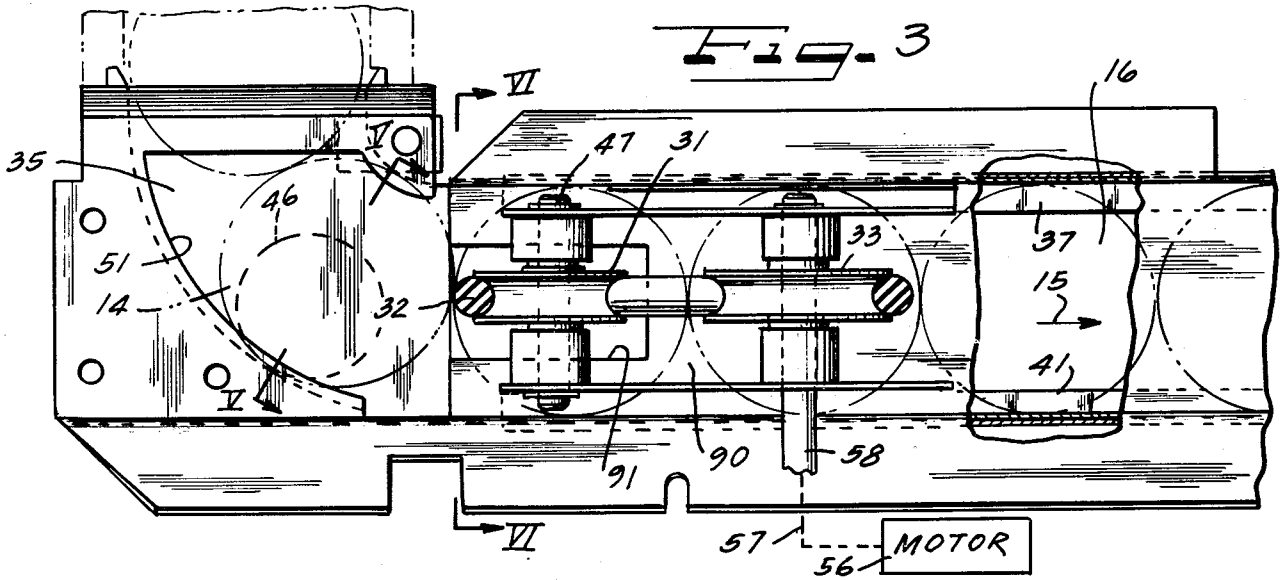
FIG. 3 is a view illustrating the coin chute and the drive mechanism.

Between the vertical chute 12 and the horizontal chute 16 is mounted transition chute portion 51 as illustrated in FIG. 3. The driving roller 31 is driven by a motor 56 illustrated in FIG. 3 which has a flexible shaft 57 connected to a shaft 58 rotatably supported by the machine on suitable bearings and which carries a pulley 58 over which the flexible belt 32 passes so as to drive pulley 31 when the motor 56 is energized.

Figure 4:
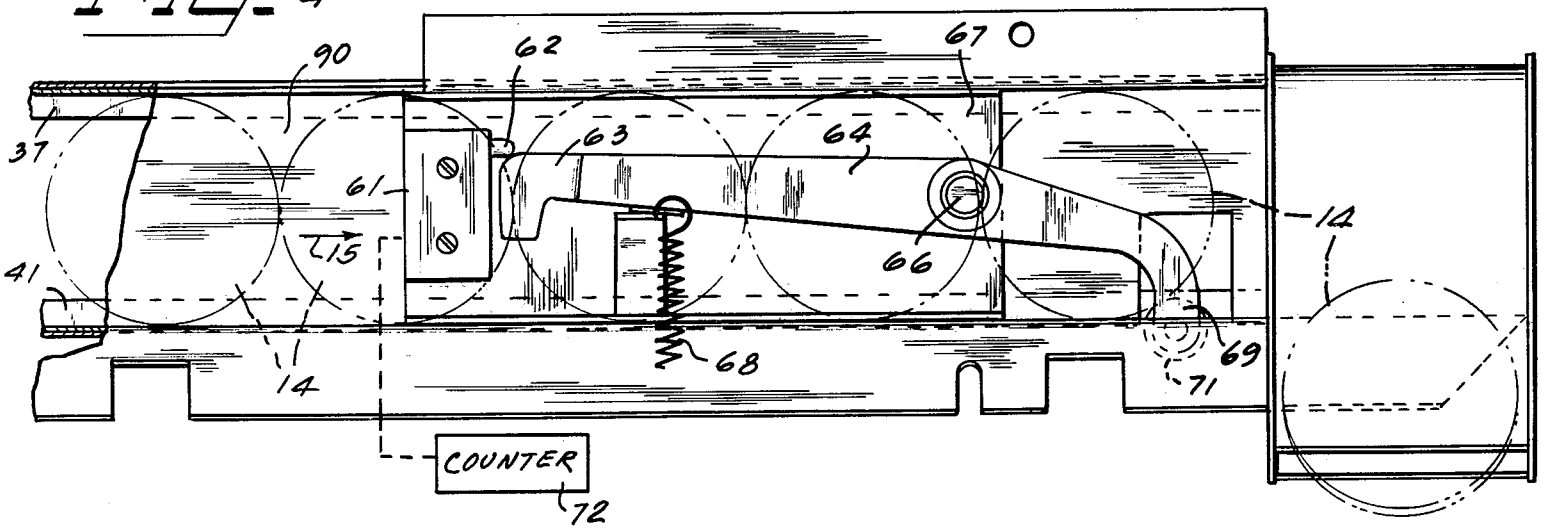
FIG. 4 illustrates the coin switch.

As shown in FIG. 4, a coin switch 61 has an actuating contact 62 engageable with one end 63 of an actuating pawl 64 which is supported on shaft 66 of the frame 67 of the machine and a spring 68 biases the end 63 of the pawl 64 downwardly relative to FIG. 4. The end 69 carries an extension upon which a roller 71 is mounted which extends transversely from the end 69 into the path of coins 14 such that the pawl 64 will be moved when a coin passes through the horizontal chute 16 and each time the coin passes the roller 71 the portion 63 of the pawl 64 will close the switch 61 by depressing the contact 62. A counter 72 is electrically connected to switch 61 and provides an output through lead 73 to the motor 56 to turn it off when a predetermined number of coins have passed by the coin roller 71 of the pawl 64 so that the machine is ready for the play cycle.

In operation, coins are placed into the coin slot 11 and pass through the vertical chute 12 and engage the transition portion 51 illustrated in FIG. 3 and pass into the horizontal chute 16 where they are engaged by the belt 32 passing over pulley 31 and are driven through the chute to the right relative to FIGS. 2, 3 and FIG. 4 and to the left relative to FIG. 1. As additional coins are inserted into the slot 11 they will pass through the vertical chute 12 and into the horizontal chute 16 due to the driving action of pulley 31 and belt 32 and a pinch roller 48. When coins are available in chute 12, the roller 31 will move them into the horizontal chute 16 pass the coin switch 64 where they will engage roller 71 and close switch 62. The counter will count three coins or three pulses from the switch 62 and will then stop the motor 56 so that additional coins will not be moved into the chute 16 by the drive pulley 31. The coins which pass the roller 71 drop into the coin receptacle 81 of the machine after passing down the chute 82 as shown in FIG. 2.

After the motor 56 has stopped, the operator can then move handle 23 to initiate the play cycle of the machine and the reels 18, 19 and 21 will spin and stop at different combinations. During this time, the operator can insert additional coins 14 into the slot 11 so that they are in a position to reload the horizontal chute 16 when the motor is again energized after the termination of the playing cycle. In a particular embodiment constructed according to the invention, the horizontal chute 16 held eight coins and the vertical chute 12 including the transition portion 51 had room for five coins.

As shown in FIGS. 2 and 8 a locking pin 121 is mounted so as to extend across the horizontal chute 16 ahead of a coin 14 when the motor 56 is de-energized. When the motor is energized, a solenoid 122 mounted on plate 123 is also energized and withdraws pin 121 from the path of coin 14 so that it can pass through chute 16 between plate 123 and lips 124 and 126. The pin 121 prevents a user from placing a sufficient number of coins in the horizontal and vertical chutes until the last coin extends out of the slot 11 and can be depressed to move the coins in the chutes. The locking pin 121 prevents such movement.

FIGS. 9 and 10 illustrate a coin feeler 108 and switch 111 which prevents the handle 23 and shaft 24 from being moved to start the play of the machine before all of the coins in the vertical chute 12 up to the maximum allowable have been accepted by the counter 72.

A slot 102 is formed in plate 35 of transition chute 51 and a coin feeler 108 extends therethrough.

The feeler 108 is part of a pivoted lever 110 which has one end 112 attached to bracket 106. A lower end 104 of lever 110 extends through an opening 103 in plate 35 near the bottom of the chute 51 and has a washer 109 which engages the back of plate 35. When the proper size coin is in chute 51 between plate 35 and guides 38 and **38*a* it will engage feeler 108 and pivot lever 110 to the position shown in dotted line in FIG. 10, thus removing end 104 from the path of the coin in chute 51 so it can pass down the chute. On the other hand an incorrect coin will have a smaller diameter than necessary to engage feeler 108 so end 104 will not move from the path of the incorrect coin 46** and it will be blocked and will fall into the return chute and not pass through the machine to give credit.

The lever 110 is engageable with a switch 111 when in the dotted line position of FIG. 10 with a proper coin in the chute. The switch 111 when closed energizes motor 56 for a preset time so that coins will be moved down the horizontal chute.

FIG. 7 illustrates power terminal 125 which is connected to switch 111. The switch 61 actuates the counter to a count of three and then actuates a solenoid 140 which opens switch 145 in series with switch 111 to motor 56. When motor 56 is energized solenoid 122 is energized to withdraw locking pin 121 so coins can pass through the chute. A locking solenoid 135 is also energized when motor 56 is energized and when energized locks shaft 24 and handle 23 so they cannot move.

It is seen that this invention provides a novel transport device for a game machine and allows coins to be placed in a vertical chute 12 as well as a horizontal chute 16 where they are visible through windows provided for this purpose. Furthermore, the invention provides due to the tilting of the horizontal chute 16, that the coins which are not of proper size will fall into a return chute and be returned to the player at the return tray 50 illustrated in FIG. 1.

The invention greatly increases the speed of play of the machine in that the coins can be placed in the slot 11 and the machine is automatically actuated after the coin switch has been pulsed.

Although the invention has been described with respect to preferred embodiments thereof, it is not to be so limited as changes and modifications may be made which are within the full intended scope as defined by the appended claims.

We claim as our invention:

1. A game machine including a vertical chute into which coins can be inserted for energizing said game machine for play, a transition chute at the lower end of said vertical chute to receive coins therefrom, a horizontal chute mounted to receive coins from said transition chute, said transition chute tilted from the vertical and formed with an opening such that coins of sizes smaller than a predetermined diameter will fall from said transition chute but coins of said predetermined diameter will remain in said chute and pass to said horizontal chute, including a coin driving means engageable with coins in said horizontal chute to move them through said horizontal chute and including a coin sensing means to detect the presence of proper coins in a chute and including a lever moveable only by a proper coin to move a blocking device in the path of coins and a driving means switch engageable by said lever.

2. A game machine according to claim 1 wherein a transparent window is mounted over said vertical chute so that coins in said vertical chute are visible.

3. A game machine according to claim 1 wherein a transparent window is mounted over said horizontal chute so that coins in said horizontal chute are visible.

4. A game machine according to claim 1 including counter means mounted to count a predetermined number of coins moving through said horizontal chute and connected to said coin driving means to stop it when a predetermined number of coins have been counted.

5. A game machine according to claim 5 wherein said counter means includes a switch, a lever mounted with one end to actuate said switch and the other end engageable with coins as they pass down said horizontal chute, and a pulse counter connected to said switch.

6. A game machine according to claim 1 wherein said coin driving means includes a motor and drive pulley engageable with said coins driven by said motor.

7. A game machine according to claim 6 wherein said motor drives said drive pulley with a flexible shaft.

8. A game machine including a vertical chute into which coins can be inserted for energizing said game machine for play, a transition chute at the lower end of said vertical chute to receive coins therefrom, a horizontal chute mounted to receive coins from said transition chute, said transition chute tilted from the vertical and formed with an opening such that coins of sizes smaller than a predetermined diameter will fall from said transition chute but coins of said predetermined diameter will remain in said chute and pass to said horizontal chute, including a coin driving means engageable with coins in said horizontal chute to move them through said horizontal chute and including a locking pin adapted to move into the horizontal chute to block the passage of coins and a locking solenoid connected to said driving means and energized when said driving means is energized.

9. A game machine including a vertical chute into which coins can be inserted for energizing said game machine for play, a transition chute at the lower end of said vertical chute to receive coins therefrom, a horizontal chute mounted to receive coins from said transition chute, said transition chute tilted from the vertical and formed with an opening such that coins of sizes smaller than a predetermined diameter will fall from said transition chute but coins of said predetermined diameter will remain in said chute and pass to said horizontal chute, including a coin driving means engageable with coins in said horizontal chute to move them through said horizontal chute, and including an actuating lever and an actuating lever lock connected to said driving means to lock said lever when the driving means is energized.

* * * * *

UNITED STATES PATENT AND TRADEMARK OFFICE

CERTIFICATE OF CORRECTION

PATENT NO. : 4,155,437

DATED : May 22, 1979

INVENTOR(S) : Roman A. Tojza and Walter M. Burnside

It is certified that error appears in the above-identified patent and that said Letters Patent are hereby corrected as shown below:

In claim 5, line 1, change "claim 5" to --claim 4--.

Signed and Sealed this

*Twentieth* Day of *May 1980*

[SEAL]

*Attest:*

SIDNEY A. DIAMOND

*Attesting Officer*

*Commissioner of Patents and Trademarks*